US007110225B1

(12) United States Patent
Hick

(10) Patent No.: US 7,110,225 B1
(45) Date of Patent: Sep. 19, 2006

(54) ARC-LIMITING SWITCHING CIRCUIT

(75) Inventor: Robert Hick, Newberg, OR (US)

(73) Assignee: Leviton Manufacturing Co., Inc., Little Neck, NY (US)

( * ) Notice: Subject to any disclaimer, the term of this patent is extended or adjusted under 35 U.S.C. 154(b) by 0 days.

(21) Appl. No.: 11/096,724

(22) Filed: Mar. 31, 2005

(51) Int. Cl.
*H02H 3/00* (2006.01)

(52) U.S. Cl. ..... 361/8

(58) Field of Classification Search ..... 361/8
See application file for complete search history.

(56) References Cited

U.S. PATENT DOCUMENTS

| | | | | |
|---|---|---|---|---|
| 3,260,894 | A | 7/1966 | Denault | |
| 3,330,992 | A * | 7/1967 | Perrins | 361/13 |
| 3,430,063 | A * | 2/1969 | Booth et al. | 361/13 |
| 3,555,353 | A | 1/1971 | Casson | |
| 3,639,808 | A | 2/1972 | Ritzow | |
| 3,982,137 | A | 9/1976 | Penrod | |
| 4,025,820 | A | 5/1977 | Penrod | |
| 4,251,845 | A | 2/1981 | Hancock | |
| 4,349,748 | A | 9/1982 | Goldstein et al. | |
| 4,356,525 | A * | 10/1982 | Kornrumpf et al. | 361/4 |
| 4,709,188 | A | 11/1987 | Roberts | |
| 4,772,809 | A | 9/1988 | Koga et al. | |
| 4,855,612 | A | 8/1989 | Koga et al. | |
| 5,309,068 | A * | 5/1994 | Hakkarainen et al. | 315/362 |
| 5,633,540 | A * | 5/1997 | Moan | 307/126 |
| 2003/0184926 | A1* | 10/2003 | Wu et al. | 361/2 |
| 2004/0027734 | A1* | 2/2004 | Fairfax et al. | 361/2 |

* cited by examiner

*Primary Examiner*—Ronald W. Leja
(74) *Attorney, Agent, or Firm*—Marger Johnson & McCollom, PC

(57) ABSTRACT

First and second switches and an arc-limiting switch are closed during a turn-on sequence in a switching circuit. The arc-limiting switch is left open during a turn-off sequence. Current flow through the switching circuit may be broken by opening the first or second switch during a turn-off sequence.

20 Claims, 1 Drawing Sheet

ARC-LIMITING SWITCHING CIRCUIT

BACKGROUND

Electronic ballasts for fluorescent lights typically have highly capacitive input circuits. When switched on, such a ballast draws a large in-rush current to charge up the capacitive load. Manufacturers of electronic ballasts have traditionally included an input filter having an inductor to limit the in-rush current. Recently, however, manufacturers have begun eliminating this input filter, and thus the task of handling the in-rush current has been placed on the switching circuitry used to control the lights.

Air-gap relays have been used to control florescent lighting due to their very high open terminal resistance. However, large in-rush currents may damage relays. When a relay is signaled to close, the internal contacts may bounce several times before ultimately closing. If this relay bounce occurs when switching on a florescent light, the large in-rush current causes arcing to occur each time the relay contacts move apart during a bounce. This arcing can damage the relay contacts. For example, the arcing may cause the contacts to weld to each other. Once welded, the contacts are permanently closed with no way to be reopened. In other cases, the arcing may cause an oxide to form on the contacts. This oxide formation may effectively insulate the contacts such that even when they close, they are still insulated from each other.

DETAILED DESCRIPTION

Figure 1:
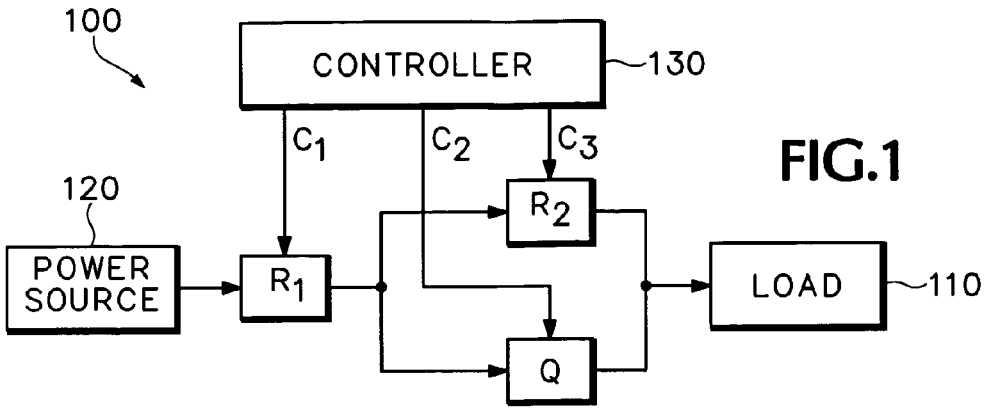
FIG. 1 illustrates an embodiment of a switching circuit constructed in accordance with some of the inventive principles of this patent application.

An embodiment of a switching circuit in accordance with the present invention is shown generally in FIG. 1. The circuit 100 of FIG. 1 includes three switches: R1, R2, and arc-limiting switch Q. In preferred embodiments R1 and R2 are air-gap relays, and Q is implemented using at least one thyristor such as a triac. In circuit 100, the relay R1 is in series with relay R2, and the triac Q is in parallel with relay R2. A controller 130 controls the opening and closing of the three switches. The circuit 100 can be used to switch current to many types of loads but the circuit 100 is particularly well adapted to switching current to florescent lights having electronic ballasts. Because of the large in-rush current such loads draw when switched on, care must be taken in order to prevent damage to the switches.

Figure 2:
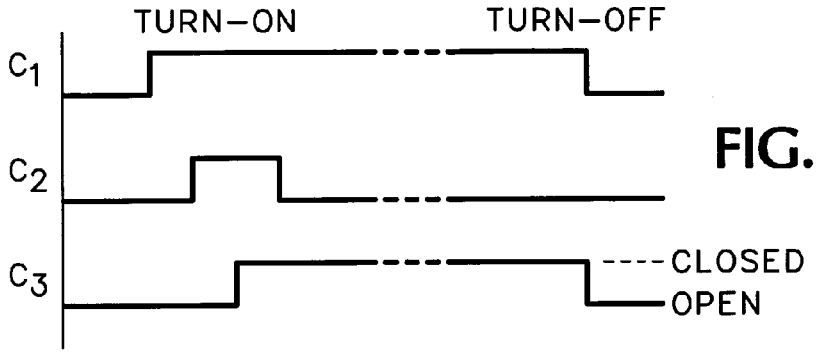
FIG. 2 illustrates a control signal timing diagram in accordance with some of the inventive principles of this patent application.

As shown in FIG. 2, a turn-on sequence for the circuit 100 may include first closing relay 1, then switching on the triac Q. Because triac Q is still off when relay R1 is closed, there is still no current path to the load and thus no arcing occurs if the contacts in relay R1 bounce. After relay R1 has closed, triac Q is then turned on to create a current path and initiate current flow. Triac Q may be controlled in various ways, some of which are described in more detail below, to limit the initial current flow through the switching circuit. Relay R2 may then be closed to divert current flow from triac Q, which may then be turned off.

The controller 130 controls the opening and closing of switches R1, Q, and R2 with control signals C1, C2, and C3 respectively. During a turn-on sequence, the control signal C1 first signals relay R1 to close. After R1 has had sufficient time to close, the control signal C2 then signals triac Q to switch. In preferred embodiments, triac Q is switched at the next zero-cross in order to minimize switching strain. This may be accomplished in any number of ways. In some embodiments triac Q may be optically coupled to a zero-cross detector that allows the triac to begin switching during a zero-cross. In other embodiments there may be other circuitry added between the controller 130 and the triac Q that detects a zero-cross and ensures the triac Q only begins switching on that zero-cross. In yet other embodiments the controller may both detect the next zero-cross and control the switching of the triac Q. Once the triac Q begins switching, a current path has been formed between the power source 120 and the load 110.

The present current path may require the triac Q to transmit a high power signal. For the triac Q to sustain such a high power signal, a large heat sink may be required to dissipate the necessary heat. In addition, if the triac Q is left in the current path, it may be susceptible to power surges that may occur. To avoid this, the control signal C3 then signals relay R2 to close, thus creating an alternate current path to take the strain off of the triac Q. In preferred embodiments, the control signal C2 then turns off the triac Q, leaving only one current path through the relay contacts. In this embodiment, no current flows through the triac Q and therefore no power is dissipated, which may alleviate the need for heat sinking the triac.

During turn-off, the switching circuit may be opened without turning the triac back on first. Although arcing may still occur across the contacts of an air-gap relay, the large in-rush currents associated with turn-on are usually not present, so the arcing may not be severe enough to damage to the contacts, or any degradation of the contacts may be so mild that the operating life of the contacts is still acceptable.

During a turn-off sequence, the current path may be broken by opening either relay first, or both at the same time. This then breaks the current flow to the load. In preferred embodiments, the turn off sequence also includes opening R1 so that there is no leakage path from the power source 120 to the load 110 through the triac Q. Although the off resistance of the triac Q may be very high, having a leakage path through the triac Q may allow large voltages to build up that can shock someone who is working on the load side of circuit 100, even when it is "off". Preferred embodiments therefore do not leave a direct leakage path through the triac Q by opening the relay R1.

Figure 3:
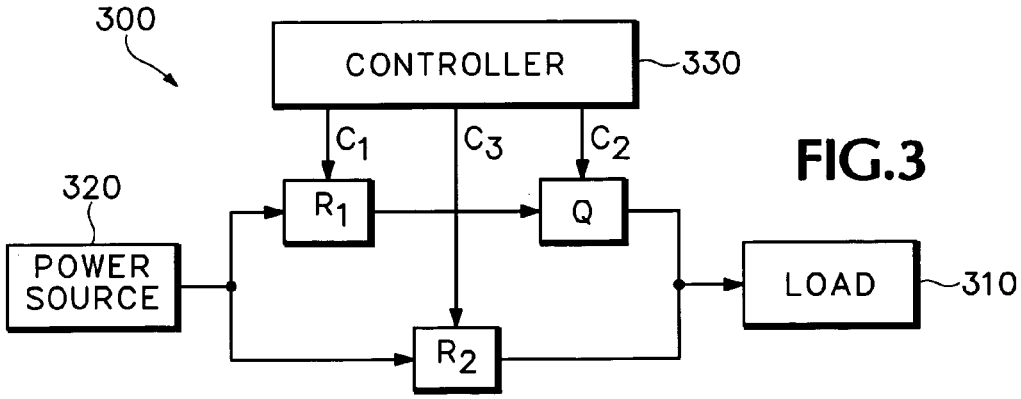
FIG. 3 illustrates another embodiment of a switching circuit constructed in accordance with other inventive principles of this patent application.

In other embodiments alternative topographies may be used. For example, FIG. 3 illustrates an embodiment of a switching circuit 300 that includes a first relay R1 in series with a triac Q and a second relay R2 in parallel with the R1-Q series combination. Circuit 300 operates similar to circuit 100 in order to switch power between a power source 320 and a load 310.

Figure 4:
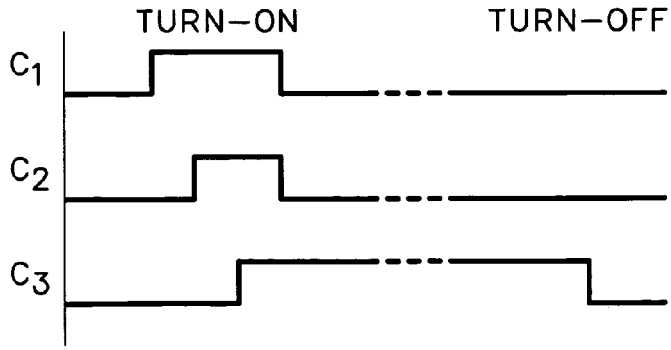
FIG. 4 illustrates another control signal timing diagram in accordance with other inventive principles of this patent application.

An embodiment of the turn-on and turn-off sequence of the circuit 300 is demonstrated in FIG. 4. Controller 330 controls the opening and closing of the switches R1, Q, and R2 with control signals C1, C2, and C3 respectively. During a turn-on sequence, the control signal C1 first signals the relay R1 to close. After the relay R1 has had sufficient time to close, the control signal C2 then signals the triac Q to switch. In preferred embodiments, the triac Q begins switching at the next zero-cross in order to minimize switching strain. After the triac Q begins switching, a current path has been formed between the power source 320 and the load 310.

For the same reasons as those of the circuit in FIG. 1, it is also not desirable for the triac Q to continuously transmit the full power delivered to the load. Therefore, once the current path has been established, the control signal C3 then signals the relay R2 to close. This creates an alternative path from the power source 320 through the relay R2 to the load 310. In preferred embodiments, the control signal C2 then stops signaling the triac Q to switch such that no current will flow through it in order to eliminate any power dissipation through the triac Q.

The turn-off sequence of the circuit 300 may include breaking the current path by opening either relay. This then stops current from flowing through the circuit 300 to the load 310. In preferred embodiments, the turn-off sequence further includes opening relay R1 so there is no leakage path between the source 320 and the load 310 through the triac Q.

Some of the embodiments disclosed in this patent application have been described with specific switches and control systems, but the inventive principles also contemplate other types of switches and control. For example, the arc-limiting switch has been described as a triac but it may be implemented as any type of switch that limits arcing. It may, for example, be implemented as any type of semiconductor switch such as thyristors, transistors, or solid state relays. Another possibility includes using a standard switch such as a relay and configuring it to operate as an arc-limiting switch by, for instance, using timing circuitry that closes the switch precisely at a zero-cross.

The inventive principles also contemplate several types of control systems. The controller may be implemented with digital circuitry such as a microprocessor or other simple digital components. Other possibilities include implementing the controller using analog circuitry. Yet other possibilities include any combination of digital and analog circuitry. Furthermore, although the invention has been described to switch power to a fluorescent light ballast, other uses are also contemplated. This circuit is well adapted to many other circuits where arcing is a concern.

Thus, the embodiments described herein can be modified in arrangement and detail without departing from the inventive concepts. Accordingly, such changes and modifications are considered to fall within the scope of the following claims.

The invention claimed is:

1. A circuit comprising:

a first switch;

a second switch in series with the first switch;

an arc-limiting switch in parallel with the second switch; and a controller to close the first switch, the arc-limiting switch, and the second switch during a turn-on sequence, and to leave the arc-limiting switch open during a turn-off sequence.

2. The circuit of claim 1 where the turn-on sequence comprises closing the first switch, the arc-limiting switch, and the second switch, in that order.

3. The circuit of claim 2 where the turn-on sequence comprises opening the arc-limiting switch after the second switch is closed.

4. The circuit of claim 1 where the turn-on sequence comprises closing the arc-limiting switch at a zero-cross.

5. The circuit of claim 1 where the arc-limiting switch comprises a semiconductor switch.

6. The circuit of claim 1 where the arc-limiting switch comprises at least one thyristor.

7. The circuit of claim 1 where the first and second switches comprise relays.

8. The circuit of claim 1 where the first and second switches comprise air-gap relays.

9. The circuit of claim 1 where the first and second switches comprise relays and the arc-limiting switch comprises a semiconductor switch.

10. A circuit comprising:

a first air-gap relay;

a second air-gap relay in series with the first air-gap relay;

at least one thyristor in parallel with the second air-gap relay; and a controller to close the first air-gap relay, switch the at least one thyristor, and close the second air-gap relay, in that order, during a turn-on sequence and to not switch the at least one thyristor during a turn-off sequence.

11. The circuit of claim 10 where the turn-on sequence comprises beginning to switch the at least one thyristor switch at a zero-cross.

12. A method comprising:

closing a first switch during a turn-on sequence;

closing a second switch in series with the first switch during the turn-on sequence;

closing an arc-limiting switch in parallel with the second switch during the turn-on sequence; and leaving the arc-limiting switch open during a turn-off sequence.

13. The method of claim 12 where the turn-on sequence comprises closing the first switch, the arc-limiting switch, and the second switch, in that order.

14. The method of claim 13 where the turn-on sequence comprises opening the arc-limiting switch after the second switch is closed.

15. The method of claim 12 where the turn-on sequence comprises closing the arc-limiting switch at a zero-cross.

16. The method of claim 12 where the arc-limiting switch comprises a semiconductor switch.

17. The method of claim 12 where the arc-limiting switch comprises at least one thyristor.

18. The method of claim 12 where the first and second switches comprise relays.

19. The method of claim 12 where the first and second switches comprise air-gap relays.

20. The method of claim 12 where the first and second switches comprise relays and the arc-limiting switch comprises a semiconductor switch.

* * * * *